US006842918B2

(12) United States Patent
Fung

(10) Patent No.: US 6,842,918 B2
(45) Date of Patent: Jan. 18, 2005

(54) HAND HELD FACIAL SAUNA

(75) Inventor: Kam Fai Fung, Hong Kong (CN)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 10/758,960

(22) Filed: Jan. 16, 2004

(65) Prior Publication Data

US 2004/0158919 A1 Aug. 19, 2004

Related U.S. Application Data

(60) Provisional application No. 60/440,060, filed on Jan. 16, 2003.

(51) Int. Cl.[7] ..... A61H 33/06
(52) U.S. Cl. ..... 4/537
(58) Field of Search ..... 4/537; 392/403

(56) References Cited

U.S. PATENT DOCUMENTS

| | | | | |
|---|---|---|---|---|
| 3,281,864 A | | 11/1966 | Linnehan | 4/161 |
| 3,749,092 A | | 7/1973 | Williams | 128/256 |
| 3,911,934 A | | 10/1975 | Helbling | 132/9 |
| 4,190,052 A | | 2/1980 | McCarthy | 607/84 |
| 4,292,971 A | | 10/1981 | Smit et al. | 604/23 |
| 4,300,556 A | * | 11/1981 | Ochi et al. | 604/291 |
| D267,898 S | | 2/1983 | Burian et al. | D23/362 |
| D271,041 S | | 10/1983 | Brun | D23/360 |
| D273,415 S | | 4/1984 | Rogers | D23/362 |
| 4,616,122 A | * | 10/1986 | Burian et al. | 392/403 |
| D305,688 S | | 1/1990 | Heiligenstein et al. | D24/201 |
| 4,903,850 A | * | 2/1990 | Frank et al. | 392/403 |
| 5,551,637 A | * | 9/1996 | Lo | 239/394 |
| 5,607,409 A | | 3/1997 | John | 604/289 |
| 6,022,327 A | | 2/2000 | Chang | 601/15 |
| D430,657 S | | 9/2000 | Allende | D23/360 |
| 6,282,369 B1 | | 8/2001 | Maier et al. | 392/403 |
| 2001/0007952 A1 | | 7/2001 | Shimizu | 607/109 |

* cited by examiner

*Primary Examiner*—Charles E. Phillips
(74) *Attorney, Agent, or Firm*—Ohlandt, Greeley, Ruggiero & Perle, LLP

(57) ABSTRACT

A sauna for vaporizing a liquid has a body with an exhaust area, and a handle. The handle is connected to the exhaust area and the handle is for grasping the sauna. The sauna has a heater in the body for changing a state of the liquid to a vapor with the vapor having a number of droplets. Each of the droplets has an initial droplet size. The sauna also has a device. The device is in the body. The device changes the initial droplet size of the droplets in the vapor exiting the exhaust area.

20 Claims, 4 Drawing Sheets

HAND HELD FACIAL SAUNA

CROSS-REFERENCE TO RELATED APPLICATIONS

This application claims priority to U.S. Provisional Patent Application Ser. No. 60/440,060 filed on Jan. 16, 2003.

BACKGROUND OF THE INVENTION

1. Field of the Invention

The present invention relates to an apparatus for providing a facial sauna. More particularly, the present invention relates to a hand held facial sauna that has an ionic generator that can apply a vapor to a user's face.

2. Description of the Related Art

A sauna is known in the art. The sauna is a personal care product that allows a user to apply a heated water vapor to a part of a body or to the entire body for relaxation. However, prior art saunas have a number of drawbacks. One such drawback is that prior art saunas require an extended period of time for which to heat an amount of liquid to create steam or water vapor that is later applied to the body part. Another such drawback is a size of droplets that are emitted or otherwise released from the prior art saunas. The size of the droplets is deficient in the prior art saunas. The size of the droplets results from heating the water in the sauna and then merely releasing the droplets from the sauna to the user without any treatment of the droplets. An improper droplet size is not conducive to saunas, especially facial saunas. If the size of the water droplets in the water vapor is relatively larger than that desired by the user for inhalation purposes and for personal massage therapy, it has been observed that the user will not enjoy the facial sauna. If the size of the water droplets in the water vapor is relatively larger than desired by the user, the water droplets will aggregate on the face. This aggregation is not conducive for inhalation purposes, let alone to penetrate the user's lungs.

Accordingly, there is a need for a facial sauna that eliminates one or more of the aforementioned drawbacks and deficiencies of the prior art.

SUMMARY OF THE INVENTION

It is an object of the present invention to provide a sauna.

It is another object of the present invention to provide a facial sauna.

It is still another object of the present invention to facial sauna that provides a water vapor having an optimal water droplet size for improved therapy.

It is yet another object of the present invention to provide a facial sauna that can rapidly generate water vapor of an optimal water droplet size in a reduced amount of time.

It is still yet another object of the present invention to provide a facial sauna that has an ionic generator.

It is a further object of the present invention to provide a facial sauna that has an ionic generator with a first electrode and a second electrode.

It is still a further object of the present invention to provide facial sauna that can treat the water vapor with a voltage and release the treated water vapor having an optimal water droplet size.

These and other objects and advantages of the present invention are achieved by a facial sauna of the present invention.

DETAILED DESCRIPTION OF THE INVENTION

Figure 1:
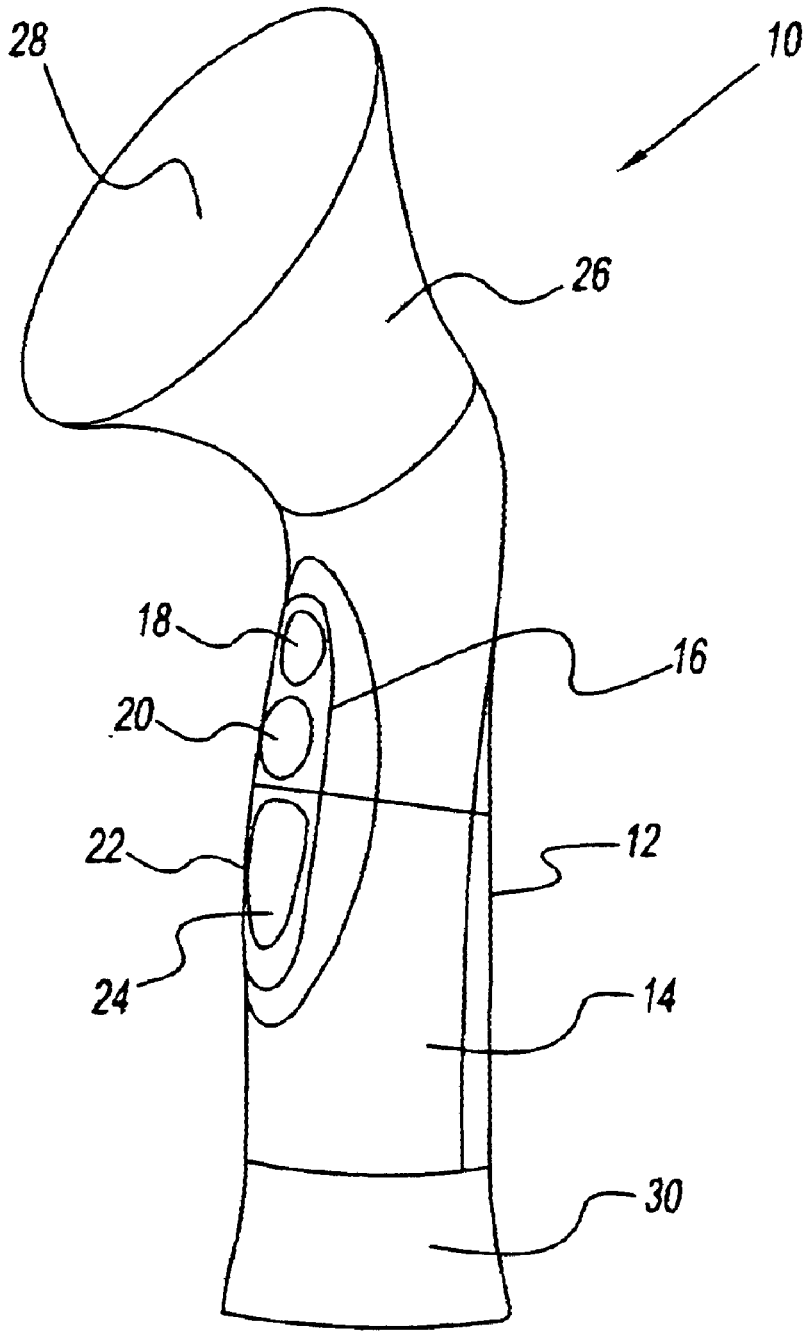
FIG. 1 is a side view of a preferred embodiment of a facial sauna of the present invention.

Referring to FIG. 1, there is provided a sauna, most preferably a facial sauna of the present invention generally represented by reference numeral 10. The facial sauna 10 preferably imparts heated and fine liquid droplets in a liquid vapor to the user's face for inhalation, relaxing massage and for therapeutic purposes. The facial sauna 10 preferably has a body 12 with a substantially cylindrical shape. The body 12 has a sufficiently sized diameter to be grasped by the hand. The body 12 also has a suitable compact height and an outer surface 14. Preferably, the body 12 is made from a resilient material such as a thermoplastic, a metal, or a polymer. However, one skilled in the art should appreciate that the body 12 may be made from any suitable resilient material known in the art.

The outer surface 14 of the body 12 preferably defines a path for which to hold and manipulate the facial sauna 10 during use and in a comfortable manner. The facial sauna 10 has a control panel 16. The control panel 16 is preferably on a recessed portion of the outer surface 14 of the facial sauna 10. The control panel 16 preferably has an arrangement of analog buttons, analog switches, digital switches, actuators, or any combination thereof, to manually control one or more functions of the facial sauna 10. In this non-limiting embodiment of the facial sauna 10, the control panel 16 of the facial sauna has a first button 18, a second button 20, and an inlet port 22. The first button 18 preferably controls whether heated liquid vapor is emitted from the facial sauna 10. The second button 20 preferably controls whether the facial sauna 10 is on or off and whether liquid is heated in the facial sauna to create the heated liquid vapor.

Figure 2:
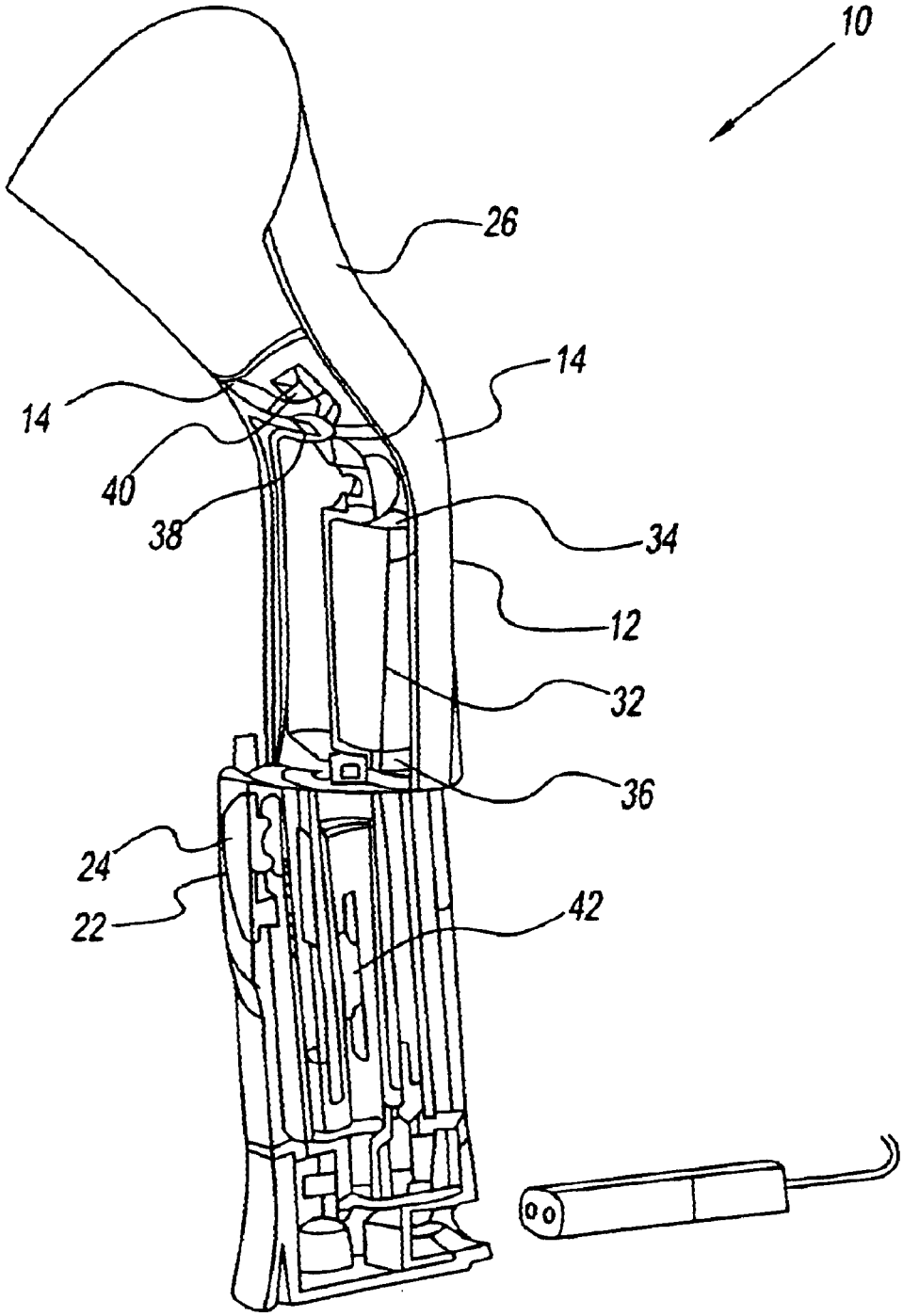
FIG. 2 is cross-sectional view of the facial sauna of FIG. 1 being unplugged.
Figure 3:
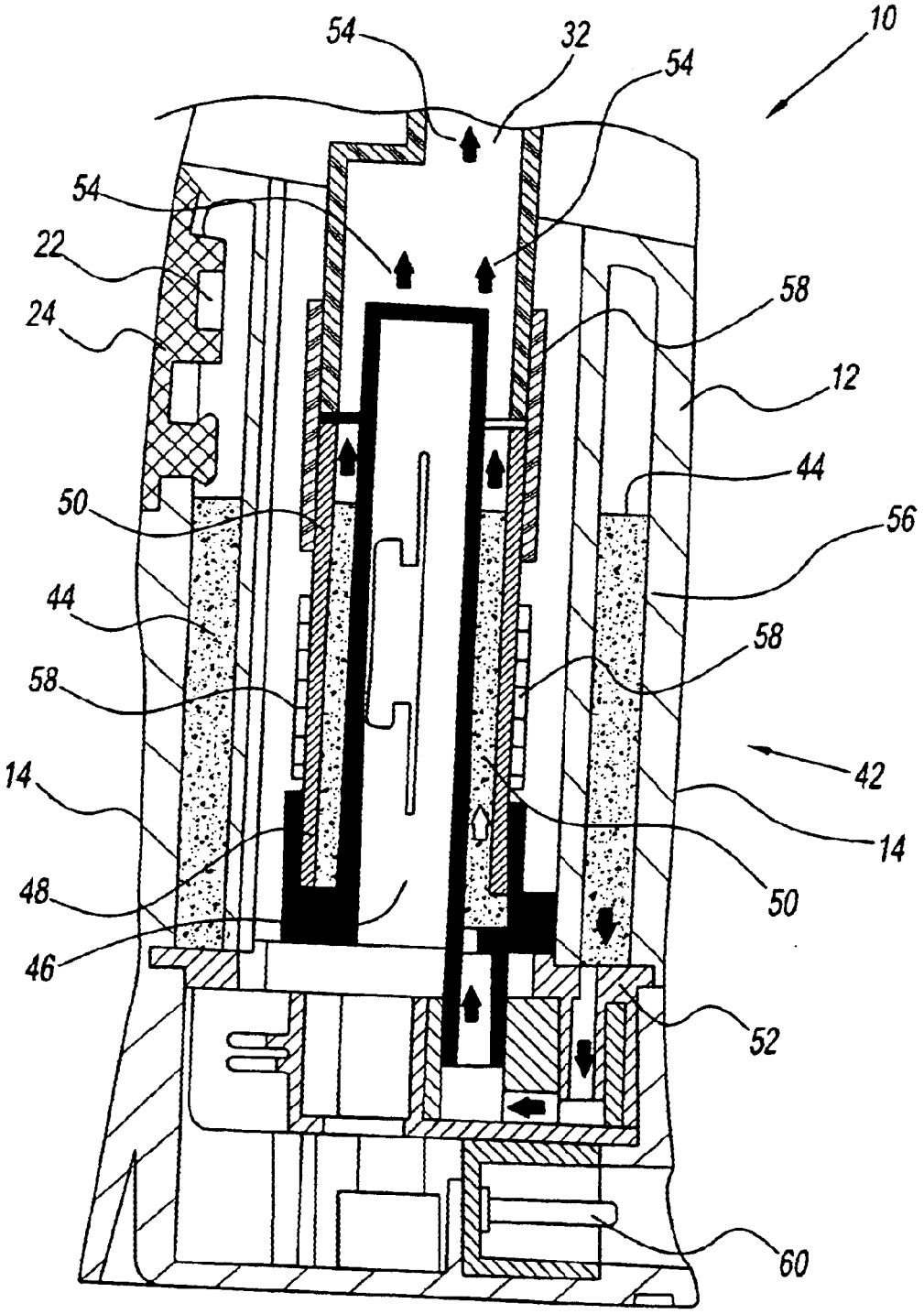
FIG. 3 is an enlarged sectional of a bottom most portion of the facial sauna of FIG. 2 showing a heater, a reservoir and a boiler assembly.
Figure 4:
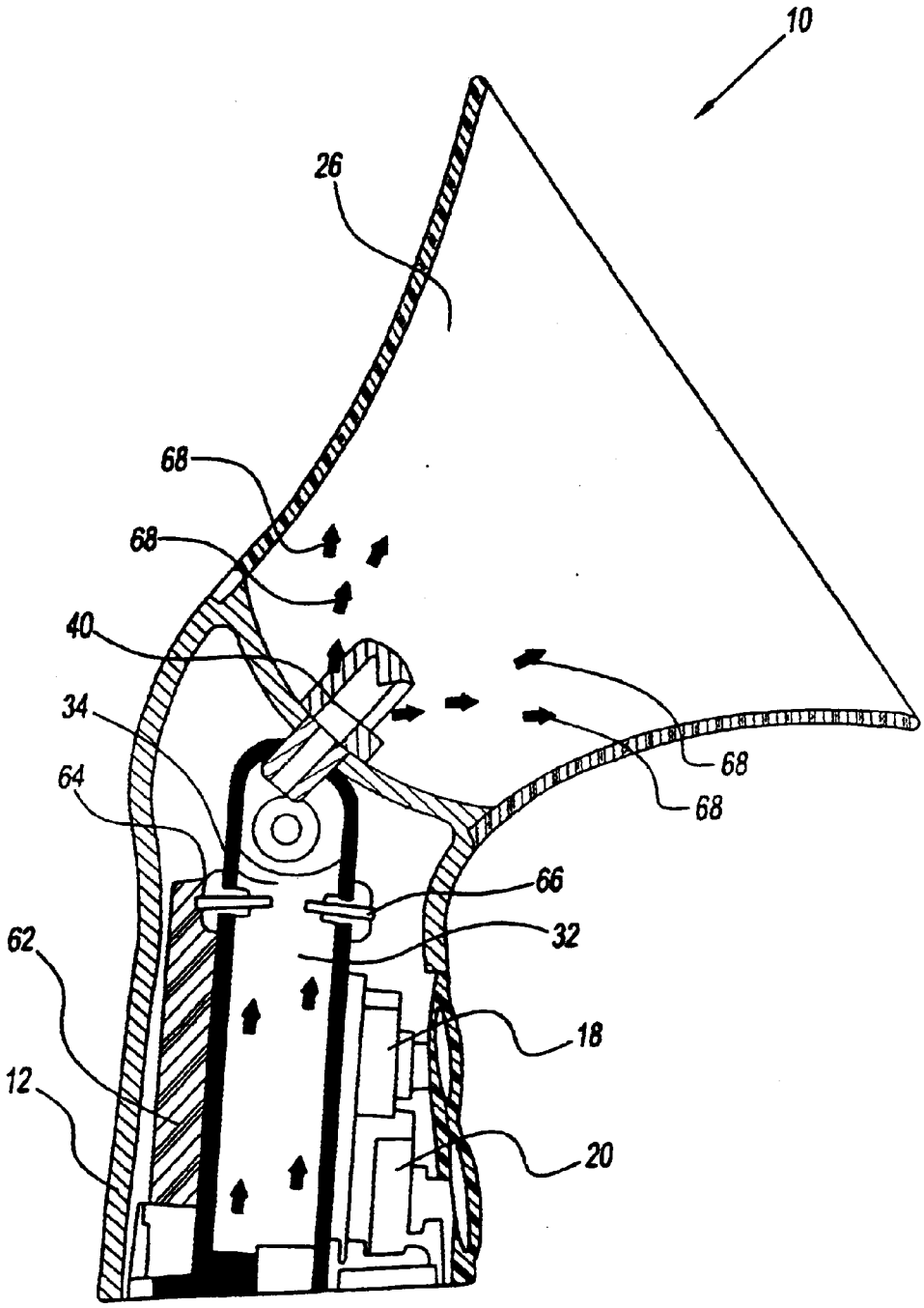
FIG. 4 is an enlarged view of a top most portion of the facial sauna of FIG. 2, rotated about ninety degrees, showing a number of water droplets being sprayed into a mask.

Preferably, the inlet port 22 acts as an opening in the outer surface 14 of the facial sauna 10. The inlet port 22 allows access to an interior space of the facial sauna 10 as shown in FIGS. 2 through 4. Preferably, the inlet port 22 can be selectively closed or opened. Preferably, the inlet port 22 is selectively opened to fill the facial sauna 10 with the liquid. The facial sauna 10 has a suitably sized rubber cap 24. The cap 24 is selectively disposed over the inlet port 22. In this manner, the user may selectively introduce the fresh liquid, preferably water, from a conventional faucet or a hose, into the facial sauna 10. This liquid will be heated in the facial sauna 10 and then subsequently emitted as a vapor from the facial sauna through a mask 26.

The facial sauna 10 has the mask 26 located on a top side of the facial sauna 10. The mask 26 is connected to the body 12. The mask 26 is preferably connected by an adhesive or by one or more mechanical fasteners. Alternatively, the mask 26 may be molded as an integral member with the body 12. Preferably, the mask 26 has a conical shape. The mask 26 has an opening 28. The opening 28 is substantially circular in shape and is opposite the body 12. The opening 28 is suitably large in order to be placed over a user's face, preferably over the user's nose, the user's mouth, or both the user's nose and the user's mouth.

In use, the mask 26 is preferably placed over the user's mouth and/or nose or both in a comfortable manner so the user's face and surrounding tissues can be massaged by the vapor and heated by the vapor. Further, the user is able to inhale the vapor for increased therapy. The mask 26 is preferably made from a resilient thermoplastic member. Preferably, the mask 26 is non-porous so that no vapor will escape through any lateral walls of the mask except through the opening 28. However, one skilled in the art should appreciate that the mask 26 may be alternatively made from any suitable metal, polymer, wood or any other resilient and solid material known in the art. One skilled in the art should appreciate that the opening 28 of the mask 26 has edges that are soft and comfortable when applied to the user's face.

As is shown in FIG. 1, the user will preferably grasp the body 12 and actuate the first and the second buttons 18, 20 on the control panel 16 by depressing the first and the second buttons 18, 20. The user will then hold the mask 26 of the facial sauna 10 over the user's face and inhale the vapor escaping from the mask. Also, the vapor will be heated to allow the vapor to massage the face at a temperature of about eight (8) to ninety (90) degrees Celsius.

At the conclusion of the therapy, the user will rest the facial sauna 10 on a floor or a counter top. Preferably, an end of the facial sauna 10 opposite the mask 26 has a flanged end 30. Preferably, the flanged end 30 has a diameter that is greater than the diameter of the body 12. In this manner, the flanged end 30 permits the facial sauna 10 to stand upright when not in use.

Referring to FIG. 2, there is shown a cross sectional side view of the facial sauna 10 of FIG. 1. Preferably, the body 12 has an exhaust manifold 32. The exhaust manifold 32 preferably is a tubular shaped conduit that is located in the body 12. The exhaust manifold 32 has a first end 34 and a second end 36 that is opposite the first end. Preferably, the first end 32 is connected to an outlet 38 of the facial sauna 10. The outlet 38 is the location where the vapor is released and/or sprayed into the mask 26. Preferably, the outlet 38 rests on a concave surface of the outer surface 14 of the body 12 as shown. A nozzle 40 is preferably disposed on the outlet 38 of the facial sauna 10. The nozzle 40 is preferably a projecting part of the facial sauna 10 with an opening at the end thereof. The nozzle 40 regulates and directs a flow of the vapor escaping from the exhaust manifold 30 and entering into the mask 26. A resulting column of vapor will fill the mask 26 for therapeutic purposes.

Referring now to the opposite end of the exhaust manifold 32, the second end 36 is preferably connected opposite the nozzle 40 to a boiler assembly 42. The boiler assembly 42 preferably converts a state of the liquid that is selectively deposited in the inlet port 22. Preferably, the boiler assembly 42 changes the liquid from a liquid state to a gaseous state or vapor by heating the liquid in excess of a boiling temperature of the liquid. The vapor then traverses upwardly opposite the boiler assembly 42. The vapor then traverses through the exhaust manifold 32 to escape into and fill the mask 26 for relaxing therapy and for inhalation purposes.

Referring to FIG. 3, there is shown a close up cross-sectional view of a bottom most portion of the facial sauna 10 of FIG. 2. As shown in more detail, the facial sauna 10 has the inlet port 22 with the removable cap 24 removably closing the inlet port. One skilled in the art will appreciate that although the facial sauna 10 is moved or shaken the liquid will not leak out of the inlet port 22.

The inlet port 22 is connected to a reservoir 44. The reservoir 44 is preferably a receptacle or chamber for storing an amount of liquid in the facial sauna 10. Most preferably, the reservoir 44 is cylindrical shaped and surrounds the boiler assembly 42. Thus, upon the boiler assembly 42 becoming heated, the liquid in the reservoir 44 will act as a barrier and absorb the heat escaping the boiler assembly 42 and prevent this heat from heating the outer surface 14 of the body 12. Thus, although the boiler assembly 42 is hot simultaneously, the outer surface 14 of the body 12 remains relativity cool and the user can hold the body in a comfortable manner. Although shown as generally cylindrical in shape, the reservoir 44 may have any shape known in the art including rectangular, spherical or irregularly shaped, and still act as the barrier to absorb the heat generated in the boiler assembly 42.

The reservoir 44 is connected to the boiler assembly 42. The boiler assembly 42 is preferably a vessel in which liquid is heated and circulated for generating vapor that enters the exhaust manifold 32. Although the boiler assembly 42 is shown as boiling water into steam, one skilled in the art should appreciate that any suitable liquid may be used and is within the scope of the present invention. The boiler assembly 42 has an inner boiler tube 46 and an outer boiler tube 48. Preferably, the inner boiler tube 46 is located in the outer boiler tube 48. A space 50 is located between the inner boiler tube 46 and the outer boiler tube 48.

The space 50 is connected to the reservoir 44 by a suitable valve 52. The valve 52 preferably is any device that regulates the flow of liquid into the boiler assembly 42 from the reservoir 44 through piping or apertures by opening, closing, or obstructing ports or passageways of the valve. The valve 52 may be selectively manually actuated by the control panel 16 or automatically by the boiler assembly 42. Upon actuating of the valve 52, liquid traverses from the reservoir 44 into the space 50. The liquid in the space 50 is then heated an amount until a boiling point temperature of the liquid is reached and the liquid is then changed from the liquid state to the gaseous state or vapor. The vapor then traverses from the space 50 through outer boiler tube 48 to the exhaust manifold 32 as illustrated by reference arrows 54.

The boiler assembly 42 of the facial sauna 10 has a thermostat 56 and a heater 58. The thermostat 56 preferably is any device known in the art that automatically responds to temperature changes and activates one or more components of the boiler assembly 42. The thermostat 54 is preferably located in the inner boiler tube 46 and is electrically connected to the heater 58 in a sealed manner. Upon reaching the desired boiling temperature, the thermostat 56 can terminate operation of the heater 58. Preferably, the thermostat 56 can terminate operation of the heater 58 at a temperature that is a predetermined amount above a temperature that the liquid reaches the boiling point temperature. Alternatively and less preferably, the facial sauna 10 may optionally have an electronic temperature control with a sensor to terminate operation of the heater 58 at the desired temperature.

The heater 58 is preferably located to substantially surround the outer boiler tube 48 of the boiler assembly 42. Simultaneously, the heater 58 is sealed from any contact with the liquid in the reservoir 44. The heater 58 preferably imparts thermal energy to the liquid located in the space 50 by conduction through the outer boiler tube 48. The heater 56 preferably heats the liquid from an ambient temperature to the boiling point temperature. Upon being heated a sufficient amount, the vapor traverses from the boiler assembly 42 to the second end 36 of the exhaust manifold 32 and into the mask 26. The heater 58 may be a resistive foil heater, an applied conductive slurry, a conductive ink heater, a heater wire, a positive temperature coefficient ceramic heater, any combinations thereof or any device to impart heat to the liquid in the space 50. The outer boiler tube 48 is preferably made from a thermally conductive material to complement the heater 58 and may optionally have one or more heat sinks (not shown) for absorbing and dissipating the heat generated by the heater.

Preferably, the heater 56 is connected to a conventional household power supply (not shown) by a power input 60. Alternatively, a battery, a number of batteries, a rechargeable battery, or any combinations thereof, may power the facial sauna 10. However, one skilled in the art should appreciate that any means or way of delivering power to the facial sauna 10 is in the scope of the present invention.

One longstanding problem in the art is a size of the droplets in the vapor that are sprayed or otherwise released from the prior art saunas. The size of the droplets in the vapor results from heating the liquid in the sauna and then merely releasing the vapor from the sauna to the user without any treatment of the vapor. A relatively large size of the droplets in the vapor is not conducive to saunas, especially facial saunas, and is especially not conducive for inhalation purposes. In fact, it has been observed that this relatively larger size of the droplets in the vapor may cause discomfort. It has been observed that the user prefers a relatively finer mist in the vapor for facial massage therapy and for inhalation purposes.

Referring to FIG. 4, the facial sauna 10 imparts a treatment to the vapor prior to spraying the vapor in the mask 26. The facial sauna 10 has an ionic generator 62. The ionic generator 62 is electrically connected to the power supply and is preferably located adjacent to the exhaust manifold 32 in the body 12. The ionic generator 62 preferably generates ions by acquiring a net electric charge by gaining or losing one or more electrons. The ionic generator 62 has a first electrode 64 and a second electrode 66. The first electrode 64 is at a first location and the second electrode 66 is at a second location in an interior side of the exhaust manifold 32, preferably close to the first end 34 and adjacent to the nozzle 40. Preferably, the first electrode 64 is directly opposite, across and facing the second electrode 66. Preferably, a distance is provided between the first electrode 64 and the second electrode 66 in order for the vapor to traverse therebetween for treatment.

Upon being actuated, the ionic generator 62 will provide an amount of voltage across the distance between the first electrode 64 and the second electrode 66. Preferably, this amount of voltage is provided in a corona discharge arc. Preferably, the amount of voltage is about 1.5 kilovolts and is provided across the distance in the arc. Most preferably, the first electrode 64 and the second electrode 66 have a different polarity than the other. The voltage preferably ionizes the vapor. This ionized vapor causes a disruption in the size of the droplets in the vapor. In this manner, the voltage changes a droplet size in the vapor exiting the nozzle 40 as shown by reference arrow 68 for illustration purposes.

Preferably, the vapor at the second end 36 of the exhaust manifold has an initial size of the droplets in the vapor. The ionic generator 62 reduces the initial size of the droplets in the vapor from the initial size of the droplets in the vapor to an optimal size. Preferably, the optimal size of the droplets in the vapor are charged and have a diameter that is relatively less than a diameter of the initial size of the droplets in the vapor released from the boiler assembly 42 shown in FIG. 3. Preferably, the optimal size results in a finer vapor as a whole relative to an instance where the initial size of the droplets in the vapor is not charged. The optimal size is relatively smaller that the prior art for improved massage, inhalation and therapy.

In one aspect, the optimal sized droplets in the vapor results in the vapor is more visible when escaping from the nozzle 40 into the mask 26 relatively to the prior art saunas. The facial sauna 10 may have a fan (not shown) in the exhaust manifold 32 for drawing the vapor to the nozzle 40. The ionic generating device 62 may be actuated by manipulation of the first button 18, the second button 20, or automatically when the thermostat 56 shown in FIG. 3 reaches a predetermined temperature or a temperature range.

It should be understood that the foregoing description is only illustrative of the present invention. Various alternatives and modifications can be devised by those skilled in the art without departing from the invention. Accordingly, the present invention is intended to embrace all such alternatives, modifications and variances.

What is claimed is:

1. A sauna for vaporizing a liquid comprising:

a body having an exhaust area and a handle connected to said exhaust area, said handle for grasping the sauna;

a heater being in said body for changing a state of the liquid to a vapor, said vapor having a plurality of droplets with each of said plurality of droplets having an initial droplet size; and a device being disposed in said body, said device for changing said initial droplet size of said plurality of droplets in said vapor exiting said exhaust area.

2. The sauna of claim 1, wherein said heater is selected from the group consisting of a resistive foil heater, an applied conductive slurry, a conductive ink heater, a heater wire, a positive temperature coefficient ceramic heater, and any combinations thereof.

3. The sauna of claim 1, wherein said device is a ionic generating device, said ionic generating device being located adjacent to said exhaust area, said ionic generating device reducing said initial droplet size of said plurality of droplets in said vapor exiting said exhaust area.

4. The sauna of claim 3, further comprising a first electrode and a second electrode.

5. The sauna of claim 1, wherein said exhaust area is connected to an exhaust manifold.

6. The sauna of claim 5, further comprising a plurality of electrodes, said plurality of electrodes being connected to an inner side of said exhaust manifold, one of said plurality of electrodes being positively charged and another one of said plurality of electrodes being negatively charged.

7. The sauna of claim 6, wherein said device is an ionic generating device, said ionic generating device being energized transmitting a voltage across said plurality of electrodes.

8. The sauna of claim 7, wherein said initial droplet size of each of said plurality of droplets traverses through said exhaust manifold, and wherein said voltage ionizes said plurality of droplets.

9. The sauna of claim 1, further comprising a nozzle, said nozzle being connected to said exhaust area for regulating and directing a flow of said vapor.

10. The sauna of claim 1, further comprising a mask connected to said exhaust area, said mask being sized to fit over an area of a user, said area of said user being selected from the group consisting of a user's mouth, a user's nose, a portion of a user's face, and any combinations thereof.

11. A hand held facial sauna for vaporizing a liquid comprising:

a tubular shaped body having an exhaust area with an exhaust manifold, said tubular shaped body being connected to a mask, said tubular shaped body having a handle for grasping the hand held facial sauna in a comfortable manner;

a heater being in said tubular shaped body for changing a state of the liquid to a vapor, said heater being selected from the group consisting of a resistive foil heater, an applied conductive slurry, a conductive ink heater, a heater wire, a positive temperature coefficient ceramic heater, and any combinations thereof, said vapor having a plurality of water droplets, each of said plurality of water droplets having an initial droplet size; and an ionic generating device being located adjacent to said exhaust area, said ionic generating device changing said initial droplet size from said initial droplet size to an optimal size.

12. The hand held facial sauna of claim 11, wherein exhaust manifold has a substantially circular shaped cross section, wherein said ionic generating device has a first electrode on an inner surface of said exhaust manifold and a second electrode on said inner surface and opposite from said second electrode, and wherein said first electrode has an opposite polarity with respect to said second electrode.

13. The hand held facial sauna of claim 12, wherein said ionic generating device generates a voltage, said voltage being provided across said first electrode and said second electrode in an arc, said vapor traversing between said arc.

14. The hand held facial sauna of claim 11, wherein said mask is shaped to fit over a user's face for inhalation of said optimal sized plurality of droplets.

15. The hand held facial sauna of claim 11, wherein said plurality of droplets with said optimal size is finer relative to said vapor having said initial droplet size.

16. The hand held facial sauna of claim 15, wherein said plurality of droplets with said optimal size are charged and have a relatively smaller diameter than said vapor with said initial droplet size.

17. A hand held facial sauna for vaporizing water comprising:

a body having a reservoir with an inlet, said inlet being connected to a cap, said body having an outlet for releasing steam, said reservoir being connected to said outlet by a tube with an inner side, said reservoir insulating said body;

a boiler for heating the water in said reservoir, said boiler changing a state of the water in said reservoir to steam, the steam having a plurality of droplets, each of said plurality of droplets having an initial droplet size;

an ionic generator being connected to an electrode, said electrode emitting a voltage in an arc to said plurality of droplets, said voltage changing said initial droplet size in the steam exiting said outlet to an optimal droplet size, said optimal droplet size having a diameter, said diameter being relatively smaller than a diameter of said initial droplet size; and a nozzle being connected to said outlet for spraying said optimal droplet sized droplets from the hand held facial sauna into a mask.

18. The hand held facial sauna of claim 17, further comprising a fan for traversing said steam from said reservoir to said outlet.

19. The hand held facial sauna of claim 17, wherein said voltage is about 1.5 kilovolts.

20. A hand held facial sauna for vaporizing a liquid comprising:

a body having a cylindrical reservoir in said body, said body having an inlet with a removable cap and an outlet for releasing a heated vapor, said cylindrical reservoir being connected to said outlet by a tube, said tube having an inner side, said body having a boiler therein;

a heater for heating the liquid in said boiler, said boiler being connected to said reservoir, said heater changing a state of the liquid in said boiler to said heated vapor, said heated vapor having a plurality of droplets, each of said plurality of droplets having an initial droplet size; and an ionic generator having a first electrode and a second electrode, said first electrode having an opposite polarity with respect to said second electrode, said first electrode emitting a voltage to said second electrode and to said plurality of droplets in said tube passing between said first electrode and said second electrode, said voltage changing a charge of said plurality of droplets passing between said first electrode and said second electrode, said charge changing said initial droplet size to an optimal droplet size, said optimal droplet size having a diameter that is relatively smaller than a diameter of said initial droplet size, said optimal droplet size being released in a mist into a mask that covers an area of a user's face.

* * * * *